United States Patent [19]

Eichkorn

[11] 4,415,046

[45] Nov. 15, 1983

[54] DEEP VIBRATOR APPARATUS AND METHOD OF USE

[75] Inventor: Franz Eichkorn, Renchen, Fed. Rep. of Germany

[73] Assignee: Fritz Pollems Kommanditgesellschaft, Fed. Rep. of Germany

[21] Appl. No.: 259,150

[22] Filed: Apr. 30, 1981

[30] Foreign Application Priority Data

May 2, 1980 [DE] Fed. Rep. of Germany ..... 3016841

[51] Int. Cl.[3] ..... E21B 7/18; E21B 7/24

[52] U.S. Cl. ..... 175/56; 175/69

[58] Field of Search ..... 175/19, 21, 55, 56, 175/65, 67; 173/49; 405/248

[56] References Cited

U.S. PATENT DOCUMENTS

| | | | |
|---|---|---|---|
| 3,312,295 | 4/1967 | Bodine, Jr. | 175/56 |
| 3,583,497 | 6/1971 | Kossowski | 173/49 |
| 3,800,889 | 4/1974 | Bauer | 175/56 |
| 3,916,634 | 11/1975 | Woodruff | 405/248 |
| 4,249,836 | 2/1981 | Schmednecht | 405/248 |
| 4,257,722 | 3/1981 | Nakajima | 405/248 |
| 4,319,784 | 3/1982 | Claringbull | 175/67 |

FOREIGN PATENT DOCUMENTS

| | | | |
|---|---|---|---|
| 933146 | 9/1973 | Canada | 175/65 |

*Primary Examiner*—Stephen J. Novosad
*Assistant Examiner*—William P. Neuder
*Attorney, Agent, or Firm*—Robert D. Yeager; Andrew J. Cornelius

[57] ABSTRACT

A deep vibrator includes a propulsion head (1) vibrating in a transverse direction with respect to the longitudinal axis of a suspension tube propulsion head being secured to the lower end of a suspension tube (2) while the outer wall of the suspension tube (2) includes pipes (4) arranged in the longitudinal direction thereof having at the lower end of the propulsion head (1) a spraying nozzle through which water may be fed under pressure, further spraying nozzles being distributed along the length of the pipes (4,5) and so aligned that they spray water into the annular space surrounding the suspension tube (2) thereby washing ground material toward the propulsion head.

6 Claims, 2 Drawing Figures

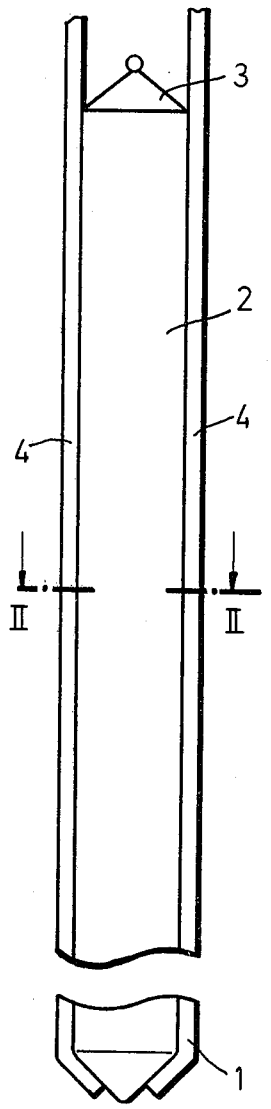
Fig.1
Fig. 2
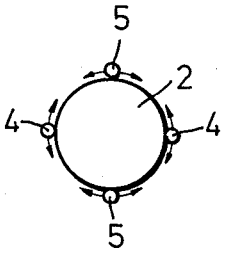

DEEP VIBRATOR APPARATUS AND METHOD OF USE

BACKGROUND OF THE INVENTION

1. Field of the Invention

The invention relates to a deep vibrator comprising a propulsion head vibrating in the horizontal direction via a driven eccentric, the propulsion head being secured to the lower end of a suspension tube while the outer wall of the suspension tube includes pipes arranged in the longitudinal direction thereof having at the lower end of the propulsion head a spraying nozzle through which water may be fed under pressure.

2. Description of the Prior Art

Deep vibrators are used in the construction of material columns in the ground, such as drainings, stop compressions, and concrete piles. To this end, the deep vibrator is driven with its propulsion head actuated by vibrations to the desired depth in the ground. Subsequently, the deep vibrator is withdrawn from the ground by means of a suitable tool while at the same time the proper filling material is filled through the deep vibrator into the hollow space so produced.

A deep vibrator having such features has been described in the journal "Baumaschine und Bautechnik", vol. 1957, no. 12, pp. 411–413. The deep vibrator described therein has a propulsion head which oscillates horizontally with respect to the longitudinal axis of the deep vibrator as it is being immersed into the ground. In this way, the propulsion head produces an annular space in the ground surrounding it, which is essentially free from ground material so that with the aid of its proper weight and the pressurized water ejected at its tip, the propulsion head may be immersed into the ground.

However, because of the annular space created around it, the oscillation of the propulsion head are not effectively transferred to the surrounding ground material as the deep vibrator is immersed. The ground material, therefore, is not pushed back sufficiently to allow an efficient immersion velocity.

French Patent Specification No. 1,277,369, discloses a deep vibrator, which vibrates vertically with respect to its longitudinal axis by means of a vibrator provided on its upper side. In order to avoid, or at least to reduce, adhesion of the deep vibrator to the ground material surrounding it when immersing it into, or withdrawing it from, the ground, pressurized water is radially ejected via openings provided in the casis of the device.

French Patent Specification No. 455,730 describes a similar device, wherein the body to be immersed is surrounded by a pipe cage in which spraying nozzles are provided.

The two latter devices are driven into the ground by vibrations in vertical direction. Therefore, no annular space is formed at the lower ends of these devices, which would facilitate an immersion of the devices into the ground.

SUMMARY OF THE INVENTION

Starting from a deep vibrator of the kind described in the beginning, it is the aim of the present invention to construct it in such a way that its immersion velocity and also its withdrawing velocity may substantially be increased.

To solve this problem, the invention is characterized in that further spraying nozzles are distributed along the length of the pipes and are so aligned that they spray the water into the annular space surrounding the suspension tube.

Experiments performed in sandy grounds have shown that by such a constructionally easy measure an immersion velocity of the deep vibrator is obtained which is three times higher as compared to the prior art deep vibrator mentioned in the beginning. This is essentially caused by the fact that along the length of the suspension tube, the ground surrounding the tube is dissolved by the pressurized water and is washed downward to the propulsion head. This ground material thus fills the annular space around the propulsion head with solid material, particularly sand, and thus causes the vibrations of the propulsion head to be very effectively transferred onto the ground surrounding the propulsion head so that the propulsion head will produce, within a very short period of time, a sufficiently large annular space for the propulsion head to immerse the deep vibrator. Experiments have shown that the water there existing does not disturb these processes, probably because it penetrates sufficiently rapidly into the surrounding ground. The characterizing measures as mentioned will moreover cause the ground around the suspension tube to be constantly kept moist so that the mud thereby formed will constitute a kind of lubricant, which prevents the suspension tube from becoming stuck when lowering the deep vibrator or when subsequently withdrawing it. Sandy grounds in particular are dissolved in the vicinity of the suspension tube so that, as experiments have shown, material piles to a depth of more than 10 meters may be produced with the novel deep vibrator without any difficulties and with a high speed.

The distance of the spraying nozzles relative to each other should be so selected that the annular space around the suspension tube is sufficiently moistened. A distance of about 15 to 25 cm of the spraying nozzles from each other has shown to be sufficient. The spraying nozzles should essentially be provided along the whole length of the suspension tube. In general, two oppositely arranged spraying pipes are sufficient to charge the annular space. More spraying pipes equally distributed around the suspension tube may however be provided as well.

For reasons of stability it is preferred to weld the spraying pipes to the suspension tube.

The spraying nozzles of the spraying pipes should spray the water in a tangential direction relative to the suspension tube because this produces the best efficiency and impairment by the portion of the spraying tubes not yet immersed into the ground.

One may also provide that the spraying pipes are subdivided in the longitudinal direction of the suspension tube into groups separately charged with the pressurized water. In that case only those groups are charged with the spraying water which are at least partly immersed into the ground so that the spraying water is not unnecessarily sprayed over the ground. These groups of spraying pipes should, in a top view of the suspension tube, be angularly displaced relative to each other in order to have room for the feed pipe for the pressurized water for the spraying pipes.

BRIEF DESCRIPTION OF THE DRAWINGS

The invention will now be described in more detail with reference to exemplified embodiments from which further important features may be taken. In the Figures, FIG. 1 is a schematic lateral view of the essential elements of a novel deep vibrator;

FIG. 2 is a schematic section along the line II—II of FIG. 1 showing an additional second group of spraying pipes.

DETAILED DESCRIPTION OF THE PREFERRED EMBODIMENTS

FIG. 1 shows the essential elements of a deep vibrator, namely a propulsion head 1, which is secured to the lower end of a suspension tube 2. Hoisting equipment not shown engages with a flange 3 of the suspension tube.

To the wall of the suspension tube, spraying pipes 4 are welded, which include nozzles provided along their lengths spraying water in the direction of the arrows (FIG. 2), i.e. essentially tangentially relative to suspension tube 2. In general, two spraying pipes 4 positioned on suspension tube 2 opposite relative to each other are sufficient.

A second set of such spraying pipes as shown in FIG. 2, at 5, may be provided as well. In this way, two groups of spraying pipes 4, 5 are formed, which may separately be charged with pressurized water. The pressure pipes for feeding the water to the spraying pipes are not shown.

The nozzles of the spraying pipes are provided in distances relative to each other of about 15 to 25 cm.

The novel deep vibrator is particularly suited to be used in sandy grounds for depths of more than about 10 meters.

Experiments have shown that with the aid of the novel deep vibrator material columns to a depth of 25 m may be produced without any problems in a ground in which prior art deep vibrators could be employed to a depth of about 15 meters only.

What is claimed is:

1. A deep vibrator comprising a suspension tube having a longitudinal axis; a propulsion head secured to the lower end of said suspension tube and adapted for vibration in a transverse direction with respect to the longitudinal axis of said suspension tube such that an annular space is formed around said propulsion head; a plurality of pipes fixedly attached along the length of the outer wall of said suspension tube; and each of said pipes ending in a nozzle and having at least one additional nozzle along its length, said nozzles adapted for spraying water under pressure into the annular space around said suspension tube as said suspension tube is inserted into the ground, thereby washing ground material toward said propulsion head.

2. The deep vibrator recited in claim 1 wherein said pipes are subdivided, in the longitudinal direction of said suspension tube, into groups separately charged with pressurized water.

3. The deep vibrator recited in claim 1 wherein said pipes are subdivided in the longitudinal direction of said suspension tube into groups separately charged with pressurized water, each of said groups having a plurality of nozzles, said nozzles discharging water only when said group is below the surface of the ground.

4. The deep vibrator recited in claim 1 wherein said spraying nozzles spray water in a direction tangential to the exterior of said suspension tube as said suspension tube is being inserted into the ground.

5. A process for inserting a deep vibrator into the ground, said deep vibrator comprising a suspension tube having a longitudinal axis and a propulsion head secured to the lower end of said suspension tube, comprising the steps of:

vibrating said propulsion head in a transverse direction with respect to the longitudinal axis of said suspension tube as the propulsion head is inserted into the ground;

ejecting water under pressure from said suspension tube in the area of a the tip of said propulsion head as said propulsion head is inserted into the ground; and releasing water under pressure from a plurality of sites along the length of said suspension tube into the ground material surrounding said suspension tube as said propulsion head is inserted into the ground causing portions of said ground material to be washed into the annular space surrounding said propulsion head.

6. The process recited in claim 5 wherein said water is released from said suspension tube in a direction tangential to the exterior surface of said suspension tube.

* * * * *